United States Patent [19]

McAlear et al.

[11] Patent Number: 4,460,887

[45] Date of Patent: * Jul. 17, 1984

[54] ELECTRICAL FUSE

[75] Inventors: Jon McAlear, Barrington Trails; Robert J. Tait, Arlington Heights, both of Ill.

[73] Assignee: Littelfuse, Inc., Des Plaines, Ill.

[ * ] Notice: The portion of the term of this patent subsequent to May 24, 2000 has been disclaimed.

[21] Appl. No.: 492,603

[22] Filed: May 9, 1983

Related U.S. Application Data

[63] Continuation-in-part of Ser. No. 245,265, Mar. 19, 1981, Pat. No. 4,385,281.

[51] Int. Cl.[3] ..... H01H 85/02

[52] U.S. Cl. ..... 337/186; 337/248; 337/414

[58] Field of Search ..... 337/186, 205, 246, 247, 337/248, 414, 415

[56] References Cited

U.S. PATENT DOCUMENTS

| | | | |
|---|---|---|---|
| 3,218,414 | 11/1965 | Swain et al. | 337/186 X |
| 3,317,690 | 5/1967 | Hollmann et al. | 337/246 |
| 3,955,167 | 5/1976 | Kumbera | 337/414 |
| 4,349,803 | 9/1982 | Tobin | 337/186 |

*Primary Examiner*—George Harris

*Attorney, Agent, or Firm*—Wallenstein, Wagner, Hattis, Strampel & Aubel

[57] ABSTRACT

An improved electrical fuse comprises an oppositely open ended insulating housing in the form of a cylindrical sleeve having a fuse element disposed therein. A pair of cup-shaped end caps close the ends of the sleeve and are electrically and physically connected to the ends of said fuse element. An external lead is connected to each of the end caps and extends outwardly therefrom. A quantity of solder in each end cap is fused to make electrical contact between the end cap and the adjacent end of the fuse element. An adherent insulating coating layer is disposed over the sleeve, end caps and leads to cover, seal, and physically interconnect the exposed exterior surfaces of said sleeve, said pair of end cap means and a portion of each lead adjacent to said pair of end cap means.

5 Claims, 8 Drawing Figures

PRIOR ART

ELECTRICAL FUSE

RELATED APPLICATION

This application is a continuation-in-part of application Ser. No. 245,265, filed Mar. 19, 1981 now U.S. Pat. No. 4,385,281.

TECHNICAL FIELD

The present invention relates to an improvement in electrical fuses.

BACKGROUND OF THE PRIOR ART

Cartridge type electrical fuses having axial leads have been long known in the fuse art. The fuse element in such a fuse is typically a fusible wire centrally supported within a cylindrical open-ended insulating sleeve forming a casing for the fuse and closed by metal end caps carrying outwardly axially extending leads. To insure reliable fusing it is essential that the fuse wire must not touch the interior wall of the sleeve along the portion of its length which can affect its fuse blowing characteristics, hence, the ends of the fuse wire are supported in such a manner as to prevent such contact. In some fuse designs, the fuse element extends diagonally across the sleeve ends. In such case, the lead carrying end caps having solder therein are used to capture the fuse wire ends folded over the outside of the sleeve ends. Final mechanical assembly consists of press fitting the end caps over the folded-over ends of the fuse wire followed by momentary heating of the solder to obtain good electrical connection between the fuse wire and the end caps. Since the fuse casing formed by the sleeve must form an insulated body, typically made of ceramic or glass, which cannot be solder bonded, the only substantial opposition to the separation of the end caps from the sleeve is derived from the pressure fitting of the end caps over the outer surface of the sleeve. Thus, such fuse structures are generally weak in tension, and are prone to mechanical failure on a pull test applied to the end leads. The alternative construction is to solder bond the end caps to the sleeve ends, which requires an expensive local outer metallization of the sleeve ends. Such structures are prone to humidity induced corrosion problems because of the exposed metal end caps and the lack of any hermetic sealing thereof.

One prior art partial solution to the above-mentioned problems comprises the application of a length of heat-shrinkable plastic tubing tightly heat shrunk over the sleeve and end caps, the tubing overlapping, although loosely, the inner ends of the leads extending outwardly from the end caps. The heat shrunk tubing provides some improvement in fuse strength and provides a moderately good sealing for the fuse interior. A disadvantage of this construction is that the cap ends are exposed to the external ambient conditions, owing to the fact that the limited shrinkage capability of the tubing prevents a desired end cap sealing engagement of the heat shrunk tubing with the leads useful when the fuse is used on printed circuit boards which after complete assembly of parts on the board, is often dropped into a liquid solvent to clean the board. Also, to impart a desired adequate corrosion resistance to the end caps, it is still necessary to plate the still exposed end caps with a corrosion resistance material.

In the fuse encased by the shrink fitted tubing, the resulting structure is still not adequately strong, in that a moderate pull on the leads can still sometimes shift the end caps to break the fuse wire.

The shrink tube fitted fuse as described also is more costly to manufacture than desired.

BRIEF SUMMARY OF THE INVENTION

According to a feature of the most preferred form of the invention, a ceramic (or the like) casing-forming sleeve, the end caps, and the adjacent portions of the power leads extending therefrom as above described are coated with a high bond strength insulating material, as, for example, an epoxy material. The epoxy material can be readily, economically applied by dipping the fuse as described previously in a body of uncured epoxy material while rotating the same about its longitudinal axis. After the epoxy is cured, the bonded insulating coating covers and strongly anchors and seals the end caps, and enhances the insulating qualities of the fuse casing, and reduces the manufacturing cost of the fuse. Evidence of the unobviousness of this fuse construction is the fact that while a similar epoxy material has been applied over prior art resistors and capacitors with coded color bands applied thereto, to our knowledge such a material has not heretofore been applied to fuses despite the extensive advantages achieved thereby.

Other objects, advantages, and features of the invention will become apparent upon making reference to the description to follow, the drawings, and the claims.

DETAILED DESCRIPTION OF INVENTION

Figure 1:
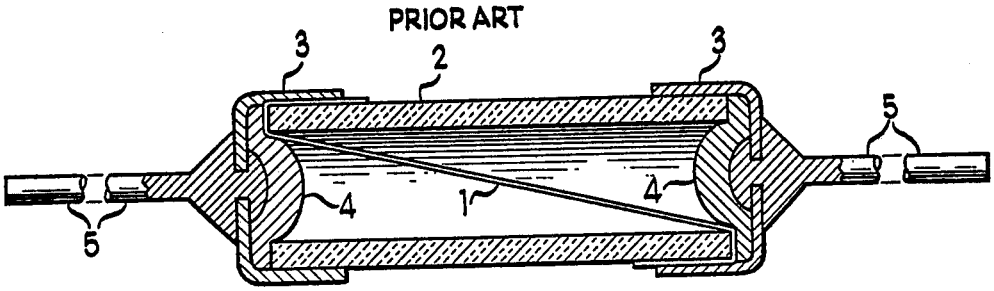
Fig 1 PRIOR ART
FIG. 1 is a partially longitudinal sectional view of a conventional fast blowing fuse.
Figure 2:
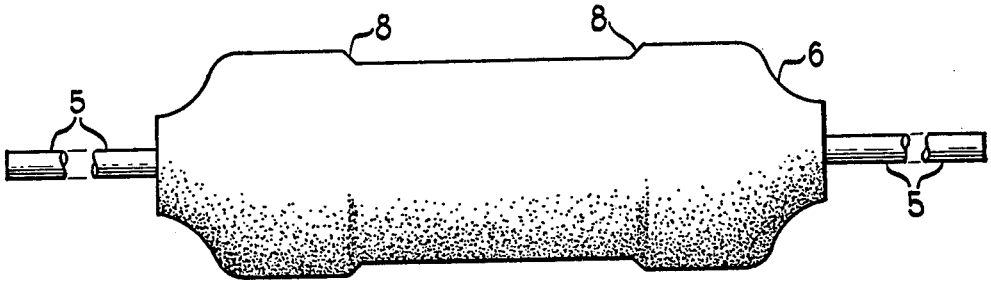
Fig 2 PRIOR ART
FIG. 2 is an elevational view of the fuse of FIG. 1 encapsulated in a heat shrunk tubing as utilized in the prior art.
Figure 3:
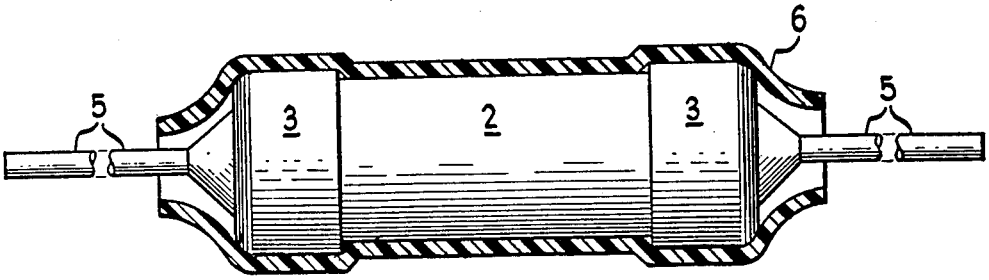
FIG. 3 is a partial longitudinal sectional view of the fuse of FIG. 2 showing the partial sealing action of the heat shrunk tubing.

Referring to the prior art fuse of FIGS. 1-3, a length of fuse wire 1 is held captive at the ends of an initially open ended cylindrical sleeve 2 by means of a pair of cup-shaped end caps 3—3 having cylindrical interior recesses receiving the ends of the sleeve 2 with a pressure fit. A body of solder 4 in each end cap 3 is heated to wet the fuse wire and secure it to the end caps 3—3. Shouldered connecting leads 5—5 pass through the center of the caps 3—3 and are secured by staking prior to assembly of the fuse structure.

FIG. 3 shows the sealing action of the heat shrunk tubing 6 over the sleeve, which seals the interface between the sleeve 2 and the end caps 3—3. The tubing 6 is applied by initially sliding a piece of loose-fitting tubing over the casing 2 and end caps 3—3 and heat shrinking it over the entire fuse assembly, which tensions the end caps towards each other to impart a degree of strength to the structure. The tubing, however, cannot shrink to a degree to engage the power leads 5—5, and, thus, the end caps 3—3 are exposed to the external environment, necessitating corrosion plating of the caps for protection against environmental conditions.

Figure 4:
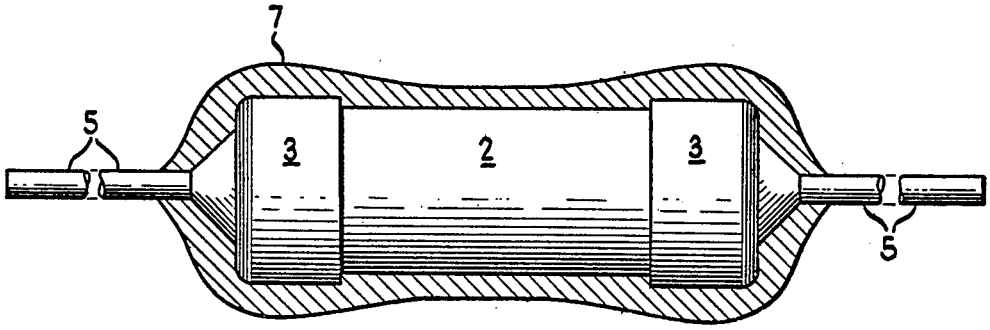
FIG. 4 is a partially longitudinal sectional view of the fuse shown in FIG. 1 after the high bond strength coating is applied thereto in accordance with the present invention.
Figure 5:
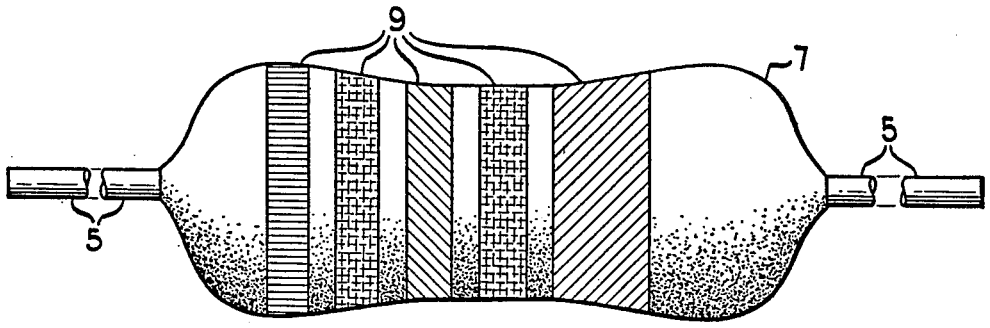
FIG. 5 is an elevational view of the fuse shown in FIG. 4, showing the disposition of color coding bands thereon.
Figure 6:
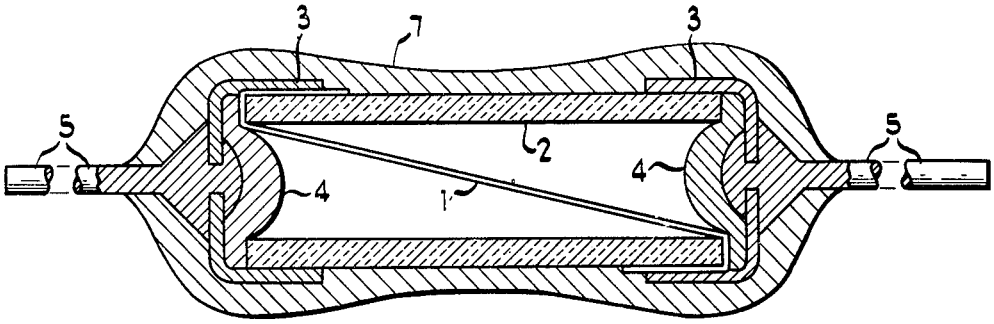
FIG. 6 is a sectional view through the fuse of FIG. 4 showing a fast blowing form of the invention.

FIGS. 4 and 5 shows a form of the invention, wherein the fuse of FIG. 2 is coated with a high-bond strength epoxy material or the like to acheive improved structural strength and a complete sealing of the sleeve 2 and end caps 3—3. In the preferred form of the invention the coating is formed by applying a heat-activated epoxy powder cascaded onto the fuse structure of FIG. 2 while the fuse is rotated about the axis of the power leads 5—5, as has been carried out for prior art resistors and capacitors. The coating is most advantageously affected by preheating the fuse to a temperature above the fusing temperature of the powder, typically in the range of 200° to 220° Fahrenheit, and below the melting point of the cap solder 4—4. The application of the powder is done in a relatively cool environment, the necessary heat being supplied by the heat stored in the fuse parts during a pre-heat process immediately before moving the fuse below a source of powder. The powder fuses as it strikes the surface of the fuse, building up to a maximum thickness set by the heat capacity and temperature of the fuse parts immediately before coating operation. By keeping the surrounding area cool during the deposition process, the cascaded powder that does not strike the fuse may be recovered and recycled. By moving the fuse to a second heating stage at the same temperature as the first stage, the initial coat is re-fused, thereby insuring rough uniformity of the coating thickness. The process is repeated to apply additional coats to build up the desired coating thickness. An air-classified powder of approximately 0.005 to 0.010 inch diameter particle size is most advantageously employed in the deposition process. After an adequate final thickness is achieved, the fuse coating is given a final oven melt of 250° Fahrenheit for two to four minutes.

As a result of surface tension effects, the epoxy coating 7 (FIG. 5) does not have the sharply angled shoulders 8 (FIG. 2) characteristic of the heat shrunk tube method, and which presented a severe obstacle to reliable color band application by conventional color wheels well-known to the art. Thus, the fuse structure shown in FIG. 5 has a moderated exterior contour adequately suited to such color banding techniques. Color bands 9 in FIG. 5 are the color coding bands applied to the body of the fuse by conventional color wheel application techniques. In the appended claims the term "moderated" as applied to the exterior contour or profile shall be construed to refer to the absence of such sharply angled shoulders.

The resulting structure is substantially hermetically sealed and, thus, requires no plating of the end caps 3 (FIGS. 3 and 4) for corrosion protection, thus resulting in a cost economy in manufacture.

Improved mechanical strength is evidenced by a series of tests run on a group of 50 fuses from a common lot. Overall length from cap to cap, measured from the outer faces was 0.220 inches. Outer sleeve diameter was 0.056 inches. A group of 25 fuses was sealed by conventional heat shrunk tubing, yielding an outer diameter over the caps of nominally 0.093 inches. A second group of 25 fuses was coated by the method described herein to a nominal overall diameter of 0.098 inches. Both groups were subjected to destructive failure testing by increasing tension on the leads. The sleeved units all failed by cap pull-off of at a mean applied force of 16.4 pounds, with standard deviation of 1.9 pounds. The coated fuses failed at a mean of 19.0 pounds with standard deviation of 0.5 pounds. A significant increase in mechanical strength is thus achieved. Moreover, all failures of the coated units were from lead wire breaks, implying that the true strength of the coated structure was in excess of the numbers quoted above.

Figure 7:
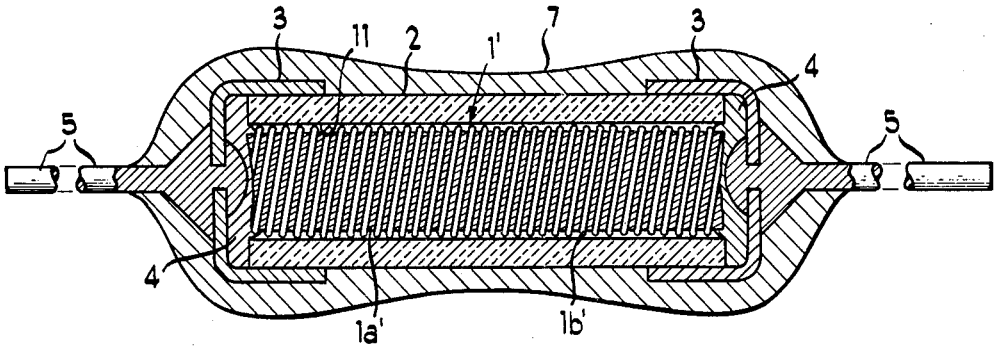
FIG. 7 is a sectional view through a modified form of the fuse of FIG. 4, where the fuse has a slow blowing fuse construction.

While one of the most important forms of the invention utilizes a diagonally extending straight fuse wire 1 as shown in FIG. 1, which is a fast blowing embodiment of the invention, the present invention is also applicable to a slow blowing fuse embodiment like that shown in FIG. 7. As illustrated, in this form of the invention, the fuse element comprises a straight self-supporting fuse element 1′ formed by a core 1*a*′ of twisted insulating filaments and a fuse wire 1*b*′ wound around the core in spiral form as shown in application Ser. No. 194,778, filed Oct. 7, 1980 which is here incorporated by reference. The diameter of the slow blowing fuse element 1′ is shown as being slightly less than the diameter of the cylindrical space 11 in the sleeve 2. Bodies of solder 4′—4′ at the ends of the sleeve 2 are shown physically surrounding and adhered to the spiral windings of the fuse wire 1*b*′ at the ends of the fuse element 1′.

Figure 8:
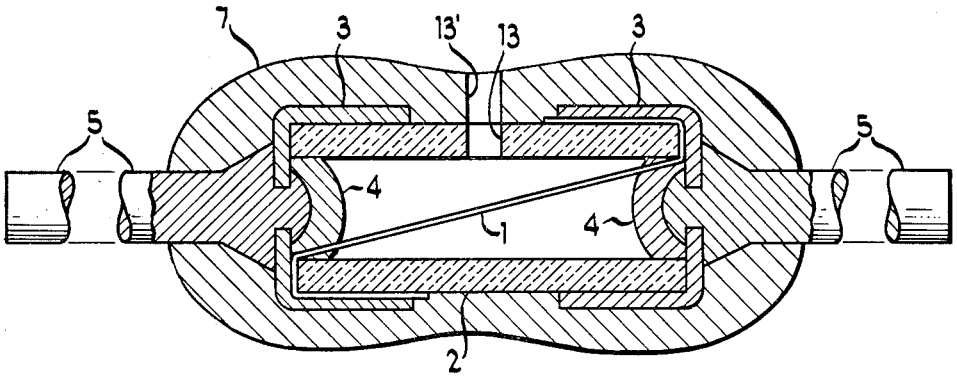
FIG. 8 is a sectional view through a modified form of the invention wherein the fuse need not be sealed from the exterior of the fuse and which for this type of fuse represents an improvement over the form of the invention shown in FIGS. 4 through 7.

Refer now to FIG. 8 which shows the most recently developed form of the invention. Because of the small size of the space 11 within the sleeve 2, the soldering operation (which involves the application of heat to the fuse after the end caps 3—3 have been applied as shown in FIG. 1 and before the application of the epoxy coating 7) causes substantial pressure to build up within the casing interior 11. This sometimes causes the solder to be forced to the exterior of the casing 2 between the end caps and the sleeve, resulting sometimes in weak solder connections within the fuse. To eliminate this pressure build-up, a vent hole 13 is formed in the casing 2 prior to the assembly of the fuse, so that the expanding air is vented during the soldering operation. This soldering operation takes place at temperatures far in excess of the 200°-220° Fahrenheit temperatures to which the partially complete fuse is heated during the application of the epoxy powder described. The heating of the fuse during application of the epoxy powder will cause the air within the casing 2 to expand through the vent opening 13 to form a hole 13′ in the coating. Where the fuse is used for printed circuit board applications, the holes 13′ and 13 are filled with any suitable material which may be an epoxy material or the like to seal the fuse. The provision of the vent hole 13 is an invention of Sam Oh.

While for the purposes of illustration, various forms of this invention have been disclosed, other forms thereof may become apparent to those skilled in the art upon reference to this disclosure and, therefore, this invention shall be limited only by the scope of the appended claims.

We claim:

1. An improved electrical fuse comprising: an oppositely open ended insulating housing in the form of a cylindrical sleeve;

a fuse element disposed within said housing;

a pair of end cap means closing the ends of said sleeve and electrically and physically connected to the ends of said fuse element, each of said end cap means being cup-shaped to provide a cylindrical recess to accommodate an end of said sleeve;

an external lead connected to each of said end cap means and extending outwardly therefrom for making external electrical connection to said fuse element;

a quantity of solder in each of said end cap means fused to make electrical contact between said end cap means and said ends of said fuse element;

said fuse element extending diagonally across the length of said sleeve housing and having a portion of each of its ends exiting the open ends of said sleeve and folded back over a portion of the external surface of said sleeve to be located between the sleeve ends and the end cap means; and an adherent insulating coating layer disposed over said sleeve end cap means and leads to cover, seal, and physically interconnect the exposed exterior surfaces of said sleeve, said pair of end cap means and a portion of each of said leads adjacent to said pair of end cap means;

and the thickness of said coating layer being adjusted to provide a step-free outer profile over the length of said sleeve and said end cap means.

2. An improved electrical fuse comprising:

an oppositely open ended insulating housing in the form of a cylindrical sleeve;

a fuse element disposed within said housing;

a pair of end cap means closing the ends of said sleeve and electrically and physically connected to the ends of said fuse element, each of said cap means being cup-shaped to provide a cylindrical recess to accommodate an end of said sleeve;

an external lead connected to each of said end cap means and extending outwardly therefrom for making external electrical connection to said fuse element;

a quantity of solder in each of said end cap means fused to make electrical contact between said end cap means and said ends of said fuse element;

said fuse element extending diagonally across the length of said sleeve housing and having a portion of each of its ends exiting the open ends of said sleeve and folded back over a portion of the external surface of said sleeve to be located between the sleeve ends and the end cap means; and an adherent insulating coating layer disposed over said sleeve end cap means and leads to cover, seal, and physically interconnect the exposed exterior surfaces of said sleeve, said pair of end cap means, and a portion of each of said leads adjacent to said pair of end cap means.

3. An improved electrical fuse comprising:

an oppositely open ended insulating housing in the form of a cylindrical sleeve;

a fuse element disposed within said housing;

a pair of end cap means closing the ends of said sleeve and electrically and physically connected to the ends of said fuse element, each of said cap means being cup-shaped to provide a cylindrical recess to accommodate an end of said sleeve;

an external lead connected to each end cap means and extending outwardly therefrom for making external electrical connection to said fuse element;

a quantity of solder in each of said end cap means fused to make electrical contact between said end cap means and said ends of said fuse element; and an adherent insulating coating layer disposed over said sleeve end cap means and leads to cover, seal, and physically interconnect the exposed exterior surfaces of said sleeve, said pair of end cap means, and a portion of each of said leads adjacent to said pair of end cap means.

4. The improved electrical fuse of claim 3 wherein said fusible element is a slow-blowing fuse element comprising a core of insulating material around which is wrapped in spiral form a fuse wire.

5. The electrical fuse of claim 3 wherein said fuse element is a straight fuse wire.

* * * * *